US010550607B2

(12) United States Patent
Lin

(10) Patent No.: US 10,550,607 B2
(45) Date of Patent: Feb. 4, 2020

(54) LATCH ASSEMBLY FOR A SLIDING DOOR

(71) Applicant: ASSA ABLOY Australia Pty Limited, Oakleigh South (AU)

(72) Inventor: Matthew Lin, Guangdong (CN)

(73) Assignee: ASSA ABLOY AUSTRALIA PTY LIMITED, Oakleigh, Victoria (AU)

( * ) Notice: Subject to any disclaimer, the term of this patent is extended or adjusted under 35 U.S.C. 154(b) by 15 days.

(21) Appl. No.: 15/552,237

(22) PCT Filed: Feb. 18, 2016

(86) PCT No.: PCT/AU2016/050110
§ 371 (c)(1),
(2) Date: Aug. 18, 2017

(87) PCT Pub. No.: WO2016/131105
PCT Pub. Date: Aug. 25, 2016

(65) Prior Publication Data

US 2018/0038134 A1 Feb. 8, 2018

(30) Foreign Application Priority Data

Feb. 20, 2015 (AU) ..... 2015900597

(51) Int. Cl.

| | |
|---|---|
| ***E05B 41/00*** | (2006.01) |
| ***E05B 63/04*** | (2006.01) |
| ***E05C 3/30*** | (2006.01) |
| ***E05B 65/08*** | (2006.01) |
| ***E05B 15/02*** | (2006.01) |
| ***E05B 63/20*** | (2006.01) |

(52) U.S. Cl.
CPC ..... *E05B 65/0811* (2013.01); *E05B 15/02* (2013.01); *E05B 41/00* (2013.01); *E05B 63/04* (2013.01); *E05B 63/20* (2013.01); *E05C 3/30* (2013.01)

(58) Field of Classification Search
CPC ..... E05B 65/0811; E05B 63/20; E05B 15/02; E05B 41/00; E05B 63/04; E05B 2063/207; E05C 3/30
USPC ... 70/461, 462, 95–100, 451, 452, 107, 432, 70/DIG. 6, DIG. 59, 150, 151 R, 151 A; 292/244, DIG. 60, DIG. 46, DIG. 53, 292/DIG. 64
See application file for complete search history.

(56) References Cited

U.S. PATENT DOCUMENTS

| | | | | |
|---|---|---|---|---|
| 4,563,885 A * | 1/1986 | Madden | E05B 13/004 | 70/105 |
| 5,092,144 A * | 3/1992 | Fleming | E05B 65/0811 | 292/244 |
| 8,424,935 B2 * | 4/2013 | Moon | E05B 55/00 | 292/163 |
| 2004/0187533 A1 * | 9/2004 | Huang | E05B 41/00 | 70/432 |

(Continued)

*Primary Examiner* — Lloyd A Gall
(74) *Attorney, Agent, or Firm* — DeLio Peterson & Curcio LLC; Thomas E. Ciesco

(57) ABSTRACT

A latch assembly 1 and a latch set 1, 2, 3, 4 for use with a sliding door frame 6. The latch assembly 1 includes a housing 48, 49, and a bolt 17 pivotable relative to the housing 48, 49 on rotation of either one of a pair of actuator hubs 51, 52. The latch assembly 1 also includes a pair of locking hubs, 53, 54 which are also rotatable to adjust the lock mechanism between an active condition and an inactive condition.

13 Claims, 8 Drawing Sheets

(56) References Cited

U.S. PATENT DOCUMENTS

| | | | | |
|---|---|---|---|---|
| 2009/0115204 | A1* | 5/2009 | Rycroft | E05B 63/20 292/341.17 |
| 2010/0052339 | A1* | 3/2010 | Chen | E05B 13/004 292/244 |
| 2010/0263418 | A1* | 10/2010 | Moon | E05B 55/00 70/107 |
| 2013/0192319 | A1* | 8/2013 | Lambrou | E05B 47/0673 70/283 |

* cited by examiner

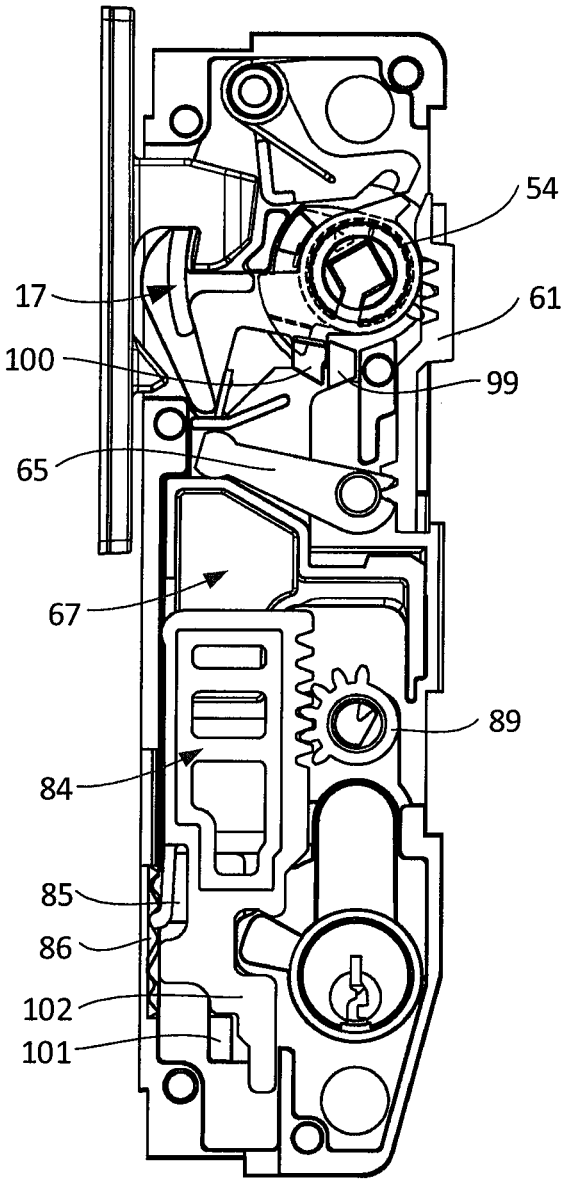
FIG 8
FIG 8A
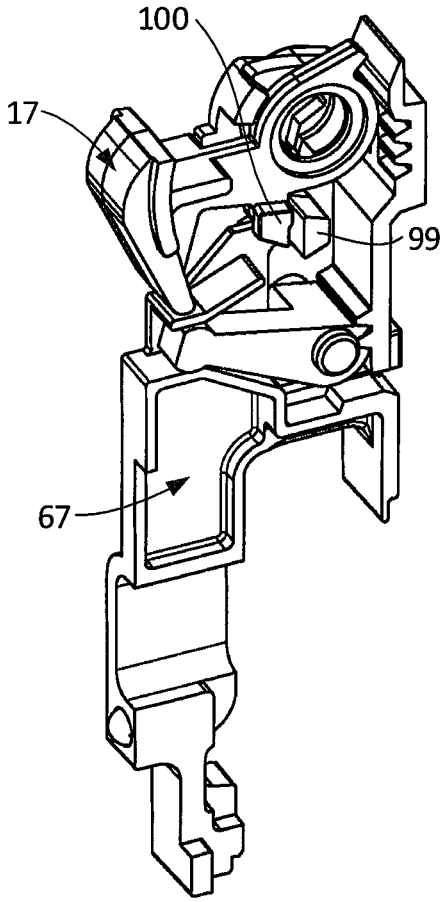

LATCH ASSEMBLY FOR A SLIDING DOOR

BACKGROUND OF THE INVENTION

1. Field of the Invention

This invention relates to a latch assembly and to a latchset for use with a sliding door. The invention has been developed for a particular application installed in a security sliding door with a frame of limited space, and it will be convenient to hereinafter describe the invention with reference to this particular application. It is to be appreciated however that the invention may have other applications.

2. Description of Related Art

A latch assembly for a security sliding door will generally include a housing and a bolt that is movable relative to the housing between a latch position and a release position. The bolt may be biased towards adopting the latch position under the influence of a spring. The latchset may include door furniture such as a hand operated snib lever, to move the bolt to a retracted position. A snib lock mechanism may also be included that is operable from an inner side of the door to hinder retraction of the bolt. A cylinder lock may also be included, for operation from either an inner side or an outer side of the door, for hindering retraction of the bolt. It should be appreciated that the door furniture can be crowded.

Where the door is a sliding security screen door it is preferred that the door furniture is streamlined, and the escutcheon or cover plates is formed with a hand grip for use when moving the door between the open and closed condition. The preference is that the grip be located on the side of the escutcheon plate opposed to the bolt, as the door jamb can obstruct access to the grip when the door is closed if the grip was placed adjacent the bolt.

The door may be installed so as to slide open to the left or to the right. This will require the latchset to be installed so that the bolt extends to the right or left respectively, while the snib remains operable from the inner side of the door only. Furthermore it is preferred that the cylinder lock remain in the same vertical orientation with its pin tumbler springs located above the barrel. Accordingly merely pivoting the latch assembly about its vertical and horizontal axis is not an acceptable option when adjusting between left hand opening door and a right hand opening door. Whilst manufacturing a left hand opening and right hand opening latch assembly would address this, it would require locksmiths to maintain a greater inventory which is not particularly efficient.

SUMMARY OF THE INVENTION

A reference herein to a patent document or other matter which is given as prior art is not to be taken as an admission that that document or matter was, in Australia, known or that the information it contains was part of the common general knowledge as at the priority date of any of the claims.

According to one aspect of this invention there is provided a latch assembly for use with a sliding door including a housing, a bolt movable relative to the housing between a latching position and a release position, a pair of actuator hubs that are each rotatable about an axis to move the bolt from the latching position to the release position, a lock mechanism including a pair of lock hubs that are each rotatable about the axis to adjust the lock mechanism between an inactive condition and an active condition so as to permit and prevent movement of the bolt from the latching position respectively, an inner hand operable member and an outer hand operable member for operation from an inner side and an outer side of the door respectively, the inner hand operable member is configured to interact with either one of the actuator hubs and either one of lock hubs while the outer hand operable member is configured to interact with either one of the actuator hubs.

The inner hand operable member may be configured in any suitable manner and in one configuration it includes an inner spindle and each lock hub include an aperture shaped to interact with the inner spindle so that rotation of the inner hand member rotates either said lock hub. The inner spindle may interact with the aperture in each lock hub in any suitable manner, and one arrangement may include the aperture in each lock hub having a groove portion shaped to mate with a protruding portion of the inner spindle, however this may vary. The outer hand operable member may be configured in any suitable manner, and in one configuration it also includes an outer spindle. The outer spindle and the inner spindle may each have a central portion, and each actuator hub may include an aperture which is shaped to mate with the central portion of either the inner spindle or the outer spindle. The outer spindle may be configured so that rotation of the outer hand operable member rotates its respective actuator hub relative to its respective lock hub.

The bolt of the latch assembly may take any suitable form however it is preferred that the bolt take the form of a hook bolt, which makes the latch assembly more suitable for use with a sliding door. The latch assembly may include a biasing means acting on the bolt urging it towards the latching position, and the hook bolt that rotates about the axis when adjusting between the latching position and the release position. The latch assembly preferably includes a pawl which interacts with the bolt when it is in the release position preventing it from moving to the latch position until the bolt is positioned adjacent an associated strike. The inclusion of the pawl has the advantage of reducing the likelihood of damage to the bolt or strike when the door is being closed.

The lock mechanism may include a detent member that moves relative to the bolt when the lock mechanism adjusts between the active condition and the inactive condition. The key operated cylinder lock may have a cam that is rotatable about a cylinder lock axis on operation of the cylinder lock. The latch assembly may include a deadlatching member which interacts with the detent member and moves relative to the detent member on rotation of the cam between a deadlatching position and a release position whereby when in the deadlatching position the lock mechanism is inhibited from adjusting from the active condition. The detent member may take any suitable form and one arrangement includes the detent member being formed with a pair of opposed shoulders that interact with the cam so that the detent member is movable relative to the bolt on rotation of the cam. The deadlatching member may also include a catch, and the housing may include an inner surface configuration which the catch interacts with so as to inhibit movement of the deadlatching member relative to the housing from the deadlatching position. It is preferred that the movement of the deadlatching member be by way of rotation of the cam so as to inhibit unauthorised or unintentional movement of the deadlatching member from the deadlatching position.

The latch assembly preferably includes an indicator visible from outside of the housing which interacts with the deadlatching member so as to visibly indicate if the deadlatching member is in a deadlatching, condition or if the lock mechanism is in an active condition. This provides the advantage of indicating to persons on the inner side of the door of the status of the lock, without having to physically try to rotate the inner turn snib.

According to another aspect of this invention there is provided a latchset assembly for use with a sliding door including a latch assembly having a housing, a bolt movable relative to the housing between a latching position and a release position, the latchset also including door furniture for positioning adjacent an inner surface and an outer surface of the door, the door furniture including a pair of hand operable members that are rotatable about an axis for rotating the bolt, a pair of escutcheons each having a cover member and a pull member for engagement by the hand of the user when sliding the door, each cover member having one aperture to accommodate one of said hand operable members there through, each cover member and pull member being configured to permit the pull member to be positioned adjacent either a left hand edge or a right hand edge of the cover member when the escutcheon is attached to the door, wherein each pull member includes a flange for gripping by the user and at least one web, the flange being integrally formed with the web.

Each pull member may include a flange that extends in a direction that is substantially parallel with said axis and at least one web for positioning between the cover member and the inner surface or outer surface of the door. Each cover member may be notched to accommodate the at least one web. In one preferred arrangement the at least one web includes a pair of webs each having an aperture therein to accommodate a fastener. It is preferred that the cover members include an inner cover member and an outer cover member for positioning adjacent an inner side and an outer side of the door respectively, wherein the inner cover member includes a pair of spaced apertures for accommodating screw fasteners there through, and the outer cover member includes a pair of spaced threaded bores formed at a rear thereof for receiving the screw fasteners. It is further preferred that each of the hand operable members includes a tab, while each aperture in the cover members includes a slot through which the tab may pass when the hand operable member is in a particular rotational position relative to the cover member, the furniture also including plates for attaching to the hand operable members once the tab has passed through the slot, the plates interacting with the cover members to prevent the hand operable members from being rotated to the particular rotational position.

According to another aspect of this invention there is provided a latch set including a latch assembly as herein before defined, and also including door furniture for positioning adjacent an inner surface and an outer surface of the door, the door furniture including escutcheons each having a cover member and a pull member for engagement by the hand of the user when sliding the door, each cover member having one aperture to accommodate one of said inner hand operable member or outer hand operable member there through, each cover member and pull member being configured to permit the pull member to be positioned adjacent either a left hand edge or a right hand edge of the cover member when the escutcheon is attached to the door.

According to still another aspect of this invention there is provided a sliding door including a latchset as herein before defined.

BRIEF DESCRIPTION OF THE DRAWINGS

It will be convenient to hereinafter describe the invention in greater detail by reference to the attached illustrations which show a preferred embodiment of various aspects of this invention. The particularity of those drawings and the related detailed description is not to be understood as superseding the generality of the invention according to each of its aspects as defined by the claims.

FIG. 8 illustrates a side elevation view of the latch assembly from FIG. 6 with the lock mechanism in an active condition.

FIG. 8*a* is partial isometric view of a detent member of the lock mechanism inhibiting rotation of the bolt to the release position.

DESCRIPTION OF THE PREFERRED EMBODIMENT(S)

Figure 1:
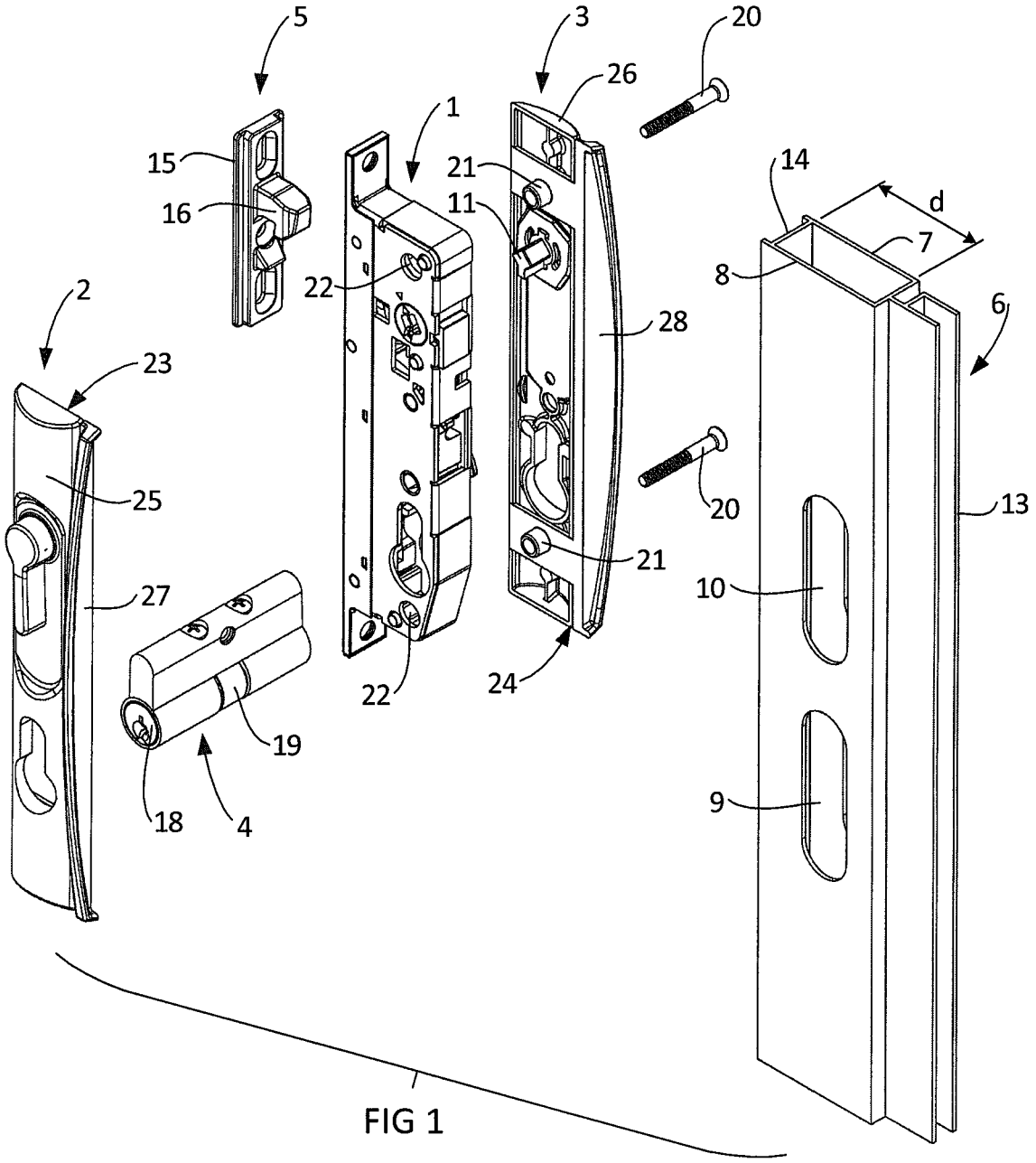
FIG. 1 illustrates an isometric view of a latchset in a partially exploded form adjacent a door frame.

Referring firstly to FIG. 1 which illustrates in summary a latch assembly 1, outer door furniture 2, inner door furniture 3, a cylinder lock 4, a strike 5, and a door frame 6. The preferred example of the door frame illustrated is in the form of an extruded metal frame of a type often used for a security door. The invention may be suitable for other forms of door frame, however the latch assembly and latchset described is particularly suited to this form of door frame 6. This type of door frame 6 has a relatively small cavity depth d to accommodate the latch assembly. Also the opposed inner wall 7 and outer wall 8 of the door frame 6 have limited space to accommodate the inner door furniture 3 and outer door furniture 2.

The door frame 6 illustrated in FIG. 1 includes a lower oblong aperture 9 formed through the outer wall 8 to accommodate the cylinder lock 4. The door frame 6 illustrated also includes an upper oblong aperture 10 formed through the outer wall 8 thereof to allow spindles 11, 12 (only an inner spindle 11 is visible in FIG. 1) associated with the door furniture 3 and outer door furniture 2 to interact with components of the latch assembly 1. The inner wall 7 includes similar apertures to the upper aperture 10 and lower aperture 9 however these are obscured in FIG. 1. The size and shape of the apertures 9, 10 in the door frame 6 may vary from that as illustrated.

The door frame 6 illustrated in FIG. 1 includes a U-shaped channel 13 at the rear thereof which is intended to accommodate a security grill (not shown) or the like when the frame forms part of a door. The frame 6 is also provided with an opening (obscured) in a front wall 14 thereof to enable the latch assembly 1 to locate within the cavity between the inner wall 7, outer wall 8 of the frame 6.

The strike 5 illustrated in FIG. 1 includes a backing plate 15 which in use is attached to a door jamb. A hook 16 projects at an angle to the backing plate for capturing a bolt 17 (see FIG. 6) of the latch assembly 1. The strike 5 may vary from that as illustrated, and in particular the hook 16 may be formed recessed inwardly of the backing plate 15.

The cylinder lock 4 illustrated in FIG. 1 is in the form of a euro cylinder which includes a pair of oppositely facing barrels 18 (only one of which is visible in FIG. 1), each for accommodating appropriately coded key (not shown). Other forms of cylinder lock 4 may also be suitable. The cylinder lock 4 includes a cam 19 positioned between the two opposing barrels 18. The cam 19 rotates about a cylinder lock axis for interaction with internal components of the latch assembly 1 which will be described in greater detail by reference to latter illustrations.

FIG. 1 illustrates a pair of screws 20 positioned adjacent the inner door furniture 3. These threaded screws 20 extend through apertures 21 formed in the inner door furniture 3, corresponding apertures 22 formed in the latch assembly 1, and locate within threaded bores (obscured in FIG. 1) extending from the rear of the outer door furniture 2. The screws 20 are used to retain the inner door furniture 3, outer door furniture 2 and latch assembly 1 in place relative to the door frame 6.

Figure 2:
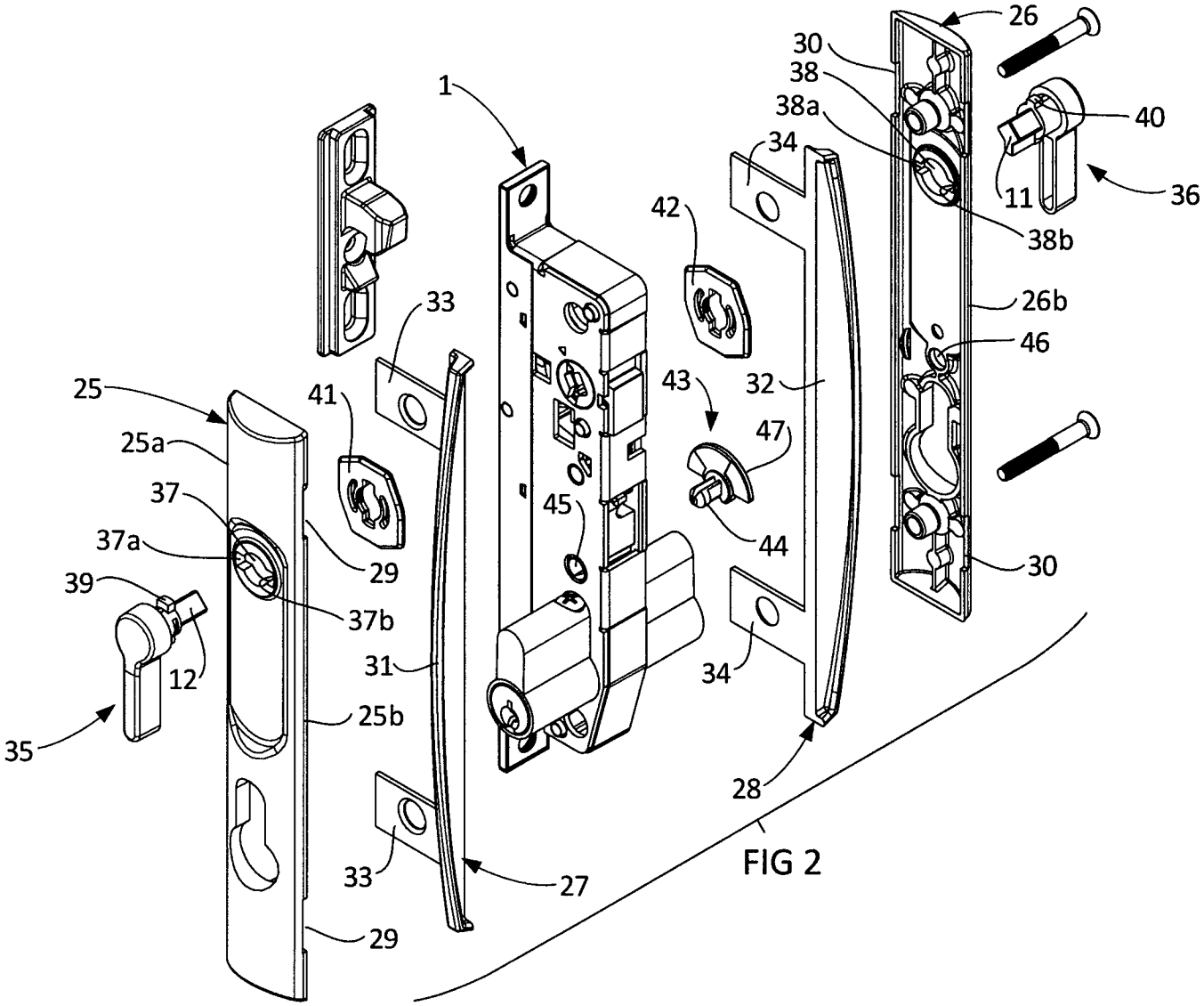
FIG. 2 is an isometric view of the latchset from FIG. 1 in a partially exploded form.

FIG. 1 illustrates the inner door furniture 3 and outer door furniture 2 each including an escutcheon 23, 24. According to one aspect of the invention each escutcheon 23, 24 is formed by a cover member 25, 26 and a pull member 27, 28. FIG. 2 illustrates a preferred embodiment of this aspect of the invention whereby the cover members 25, 26 is a substantially elongate plate each formed with a pair of notches 29, 30 at the rear thereof. The preferred embodiment of the pull members 27, 28 as illustrated in FIG. 2 includes a substantially elongate flange 31, 32 that extends in a direction which is parallel with the longitudinal direction of the cover plate 25, 26. FIG. 2 also illustrates a pair of webs 33, 34 extending perpendicularly to the flange 31, 32 each web 33, 34 locates in its respective notch 29, 30. The number and location of the webs 33, 34 may clearly vary from that as illustrated in FIG. 2.

According to one aspect of the invention each door furniture 2, 3 includes a hand operable member, which in the embodiment illustrated in FIG. 2 is in the form of a turn snib 35, 36. Each cover plate 25, 26 includes an upper aperture 37, 38 which is configured to accommodate the spindle 12, 11 of its respective turn snib 35, 36. It is preferred that each turn snib 35, 36 be captured by its respective cover plate 25, 26, and this may be achieved by any suitable arrangement. In the arrangement illustrated in FIGS. 2, 4 and 5 by each turn snib 35, 36 including a tab 39, 40 which is illustrated extending vertically from its respective spindle 12, 11. Each upper aperture 37, 38 is formed with a pair of opposed horizontal slots 37*a,b*, 38*a,b* which can accommodate its respective tab 39, 40 to allow it to pass therethrough when the turn snib 35, 36 is oriented in substantially horizontal position. Once the tab has passed through the slot 37 *a,b*, 38 *a,b* the turn snib may be returned to a substantially vertical orientation thereby capturing the turn snib 35, 36 relative to the cover plate. While it remains in the substantially vertical orientation. Clearly the number and location of tabs and slots may vary from that as illustrated, and FIG. 2 illustrates one preferred arrangement.

The furniture also includes plates 41, 42 for attaching to each respective spindle 12, 11 once the tab 39, 40 has passed through the slot 37 *a,b*, 38 *a,b*. Each plate 41, 42 illustrated in FIG. 2 interacts with its respective spindle 12, 11 in a friction fit however this may vary. The shape of each plate 41, 42 is configured to interact with side walls 25 *a,b*, 26 *a,b* of cover plate 25, 26 to limit rotation of each respective turn snib 35, 36. More specifically, each turn snib 35, 36 is prevented from rotating to the horizontal position whilst its plate 41, 42 each is attached so as to prevent its tab 39, 40 being aligned with a slot 37 *a,b*, 38 *a,b*.

FIG. 2 also illustrates an indicator member 43 having a shaft 44 which locates within an aperture 45 formed in the latch assembly 1. The inner cover member 26 is also formed with a viewing aperture 46 through which a colored disc of the indicator 43 is visible from outside of the inner furniture 26. The manner in which the indicator 43 operates will be described in greater detail by reference to latter illustrations.

Figure 3:
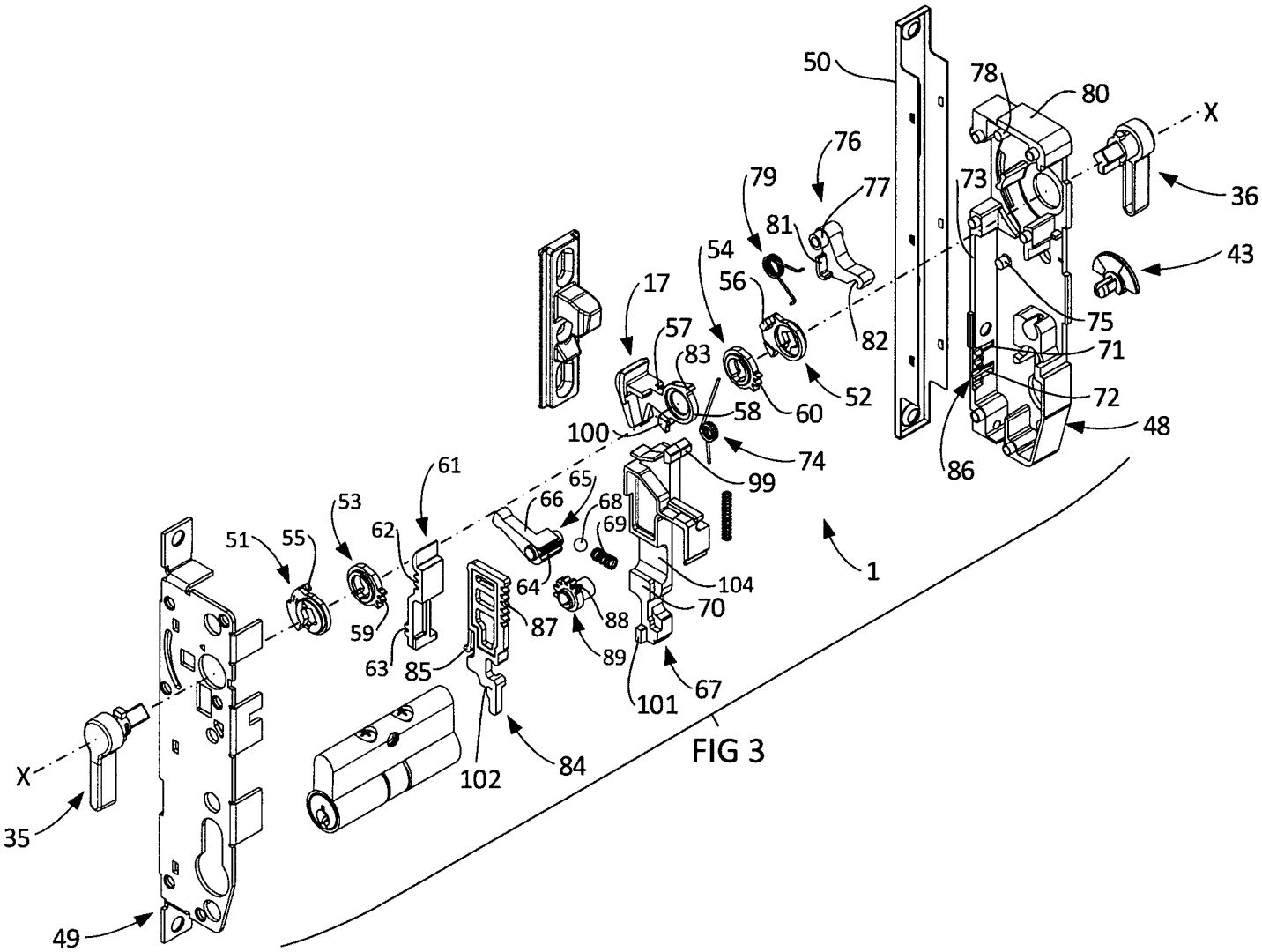
FIG. 3 illustrates an isometric view of the latch assembly from FIG. 2 in exploded form.

Referring now to FIG. 3 which illustrates a preferred aspect of the latch assembly 1 according to another aspect of the invention. In this aspect of the invention the latch assembly 1 also includes the hand operable members previously described with reference to the earlier aspect of the invention as turn snibs 35, 36. FIG. 2 illustrates that the latch assembly 1 includes a housing 103, and FIG. 3 illustrates that the housing 103 may be formed by a base 48, a cover 49 and a face member 50. FIG. 3 illustrates a pair of actuator hubs 51, 52 that are each rotatable about an axis X-X. The latch assembly 1 also includes a pair of lock hubs 53, 54 which are again each rotatable about the axis X-X. Whilst both the actuator hubs 51, 52 are each rotatable about the axis X-X via rotation of its respective turn snib 35, 36, only the lock hub 54 associated with the inner turn snib 36 is rotatable about the axis X-X on rotation of the inner turn snib 36. More specifically rotation of the outer turn snib 35 does not result in rotation of the outer lock hub 53 for reasons which will be explained in greater detail by reference to latter illustrations.

FIG. 3 illustrates the preferred embodiment of the bolt 17 which is configured to interact with each actuator hub 51, 52. Each actuator hub 51, 52 is formed with a shoulder 55, 56 (See also FIGS. 4, 5) with the shoulder 56 formed on the inner actuator hub 52 more clearly visible. Each shoulder 55, 56 is positionable adjacent a radial arm 57 extending off a central hub 58 of the bolt 17 so that rotation of either actuator hub 51, 52 results in rotation of the bolt 17 about the axis X-X.

The lock hubs 53, 54 form part of a lock mechanism which is adjustable between an active condition and an inactive condition so as to prevent and permit movement of the bolt 17 from the latching position respectively. The lock mechanism may take any form to achieve this function and FIG. 3 illustrates each lock hub 53, 54 being formed with gears 59, 60 on a portion of their periphery. These gears interact with a slide member 61 which is movable vertically within the latch assembly housing. The slide member 61 has an upper rack portion 62 and a lower rack portion 63 and the gears 59, 60 on the periphery of each lock hub are configured to interact with the upper rack portion 62. The lower rack portion 63 is configured to interact with gears 64 formed on a lever 65. The lever 65 has a lever arm 66 which interacts with a recess 104 formed in a detent member 67 so that adjustment of the lever arm 66 raises or lowers the detent member 67 within the housing. The adjustment of the detent member 67 corresponds to adjustment of the condition of the lock mechanism. This movement of the detent member 67 will be described in greater detail by reference to FIG. 8.

FIG. 3 also illustrates a ball detent 68 with a coiled compression spring 69 which locate within a blind bore (obscured) formed in a lower leg 70 of the detent member 67. The ball detent 68 interacts with an upper recess 71 and lower recess 72 formed in a front wall 73 of the base 48 of the latch assembly housing. This interaction assists in positively locating the detent member 67 in a raised or lowered position relative to the latch assembly housing.

The bolt 17 is preferably biased towards the latching position. FIG. 3 illustrates a bolt torsion spring 74 which acts on the bolt 17 and locates on a stud 75 extending from the base 48 when the latch assembly is assembled. A short arm of the torsion spring 74 abuts against the front wall 73 of the base 48 whilst the long arm of the torsion spring 74 interacts with the bolt 17. (See FIG. 6).

It is preferred that the latch assembly 1 include a pawl 76 for interacting with the bolt 17 to prevent it from adopting the latch position until the latch assembly 1 is positioned adjacent the strike 5. This reduces the likelihood of the bolt 17 slamming into the hook 16 of the strike 5 and damaging the bolt 17 or hook 16. FIG. 3 illustrates the preferred embodiment of the pawl 76 being formed with a bore 77 which fits on a stud 78 formed in the base 48. The pawl 76 pivots about this stud 78 against the urging of a pawl torsion spring 79 which has one arm thereof engaging an upper wall 80 of the base 48 and another arm engaging a shoulder 81 on the pawl 76 when assembled. A distal end of the pawl arm includes a notch 82 to interact with protrusion 83 formed on the bolt hub 58 when the bolt 17 is in a retracted position (See FIG. 7). The bolt 17 is released from the pawl 76 by the hook 16 of the strike 5 abutting the shoulder 81 of the pawl 76, causing the pawl 76 to rotate (see FIG. 6).

The latch assembly 1 preferably includes a deadlatching member 84, that when in a deadlatching position inhibits adjustment of the lock mechanism from the active condition. FIG. 3 illustrates a preferred embodiment of the deadlatching member 84. Whilst the adjustment of the deadlatching member 84 will be described in greater detail by reference to latter illustrations, FIG. 3 illustrates the deadlatching member 84 being formed with a locating latch 85 formed at a side thereof. The catch or latch 85 interacts with a ribbed formation 86 formed in the front wall 73 of the base 48. FIG. 3 also illustrates an opposed side edge of the deadlatching member 84 being formed with a rack 87 for interaction with gears 88 formed on a pinion 89 so that vertical movement of the deadlatch member 84 causes the pinion 89 to rotate. The pinion 89 in turn interacts with the indicator 43 so as to cause the indicator to also rotate, indicating the adjustment of the condition of the deadlatching member 84.

Figure 4:
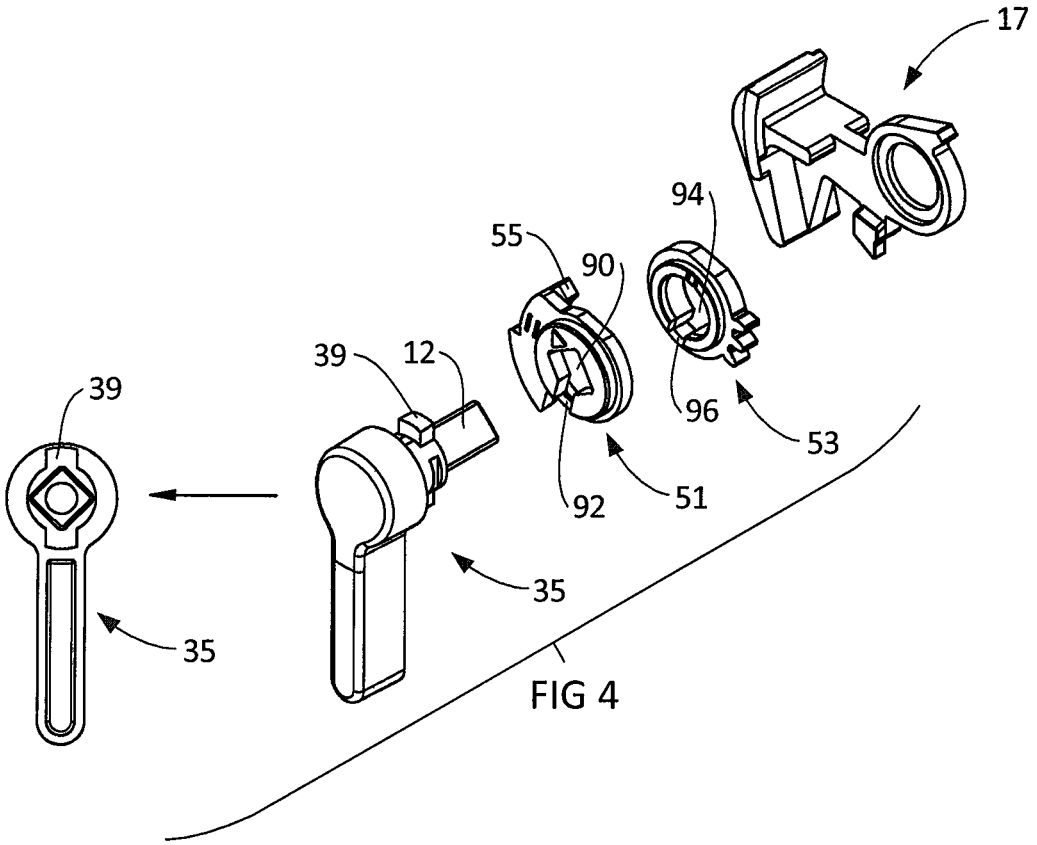
FIG. 4 illustrates an isometric view of an outer hand operable member, actuator hub, lock hub, and bolt from FIG. 3.
Figure 5:
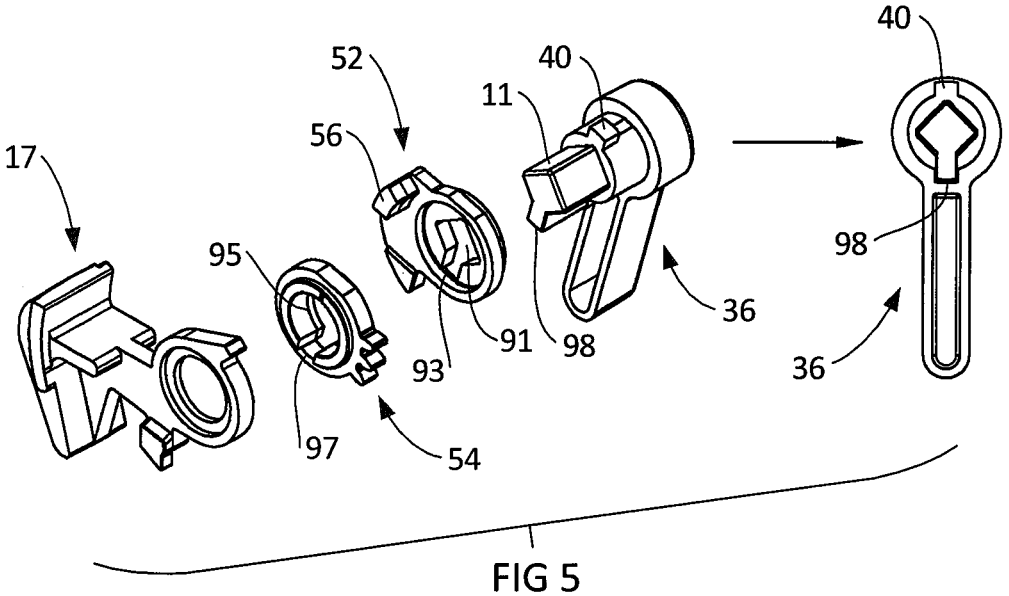
FIG. 5 illustrates an isometric view of an inner hand operable member, actuator hub, lock hub, and bolt from FIG. 3.

The latch assembly 1 according to the invention includes an inner hand operable member and an outer hand operable member which may take any form. FIGS. 4 and 5 illustrate the inner hand operable member and outer hand operable member as turn snibs 35, 36, as this is preferred for providing a slimline appearance. However the turn snibs 35, 36 may be replaced, particularly if the door frame 6 has greater space. FIG. 4 illustrates in greater detail a preferred embodiment of the outer snib lever 35. It can be noted more easily in FIGS. 4 and 5 that both actuator hubs 55, 56 have a central aperture 90, 91 that is square in cross-section and a radially extending groove 92, 93. The central aperture 90, 91 in each actuator hub is square in cross-section so as to match the shape of each spindle 12, 11, however, this may vary. The lock hubs 53, 54 illustrated in FIGS. 4 and 5 each have a central aperture 94, 95 and a radially extending groove 96, 97. Each central aperture 94, 95 is circular in cross-section which does not match the shape of each spindle 12, 11. Whilst FIGS. 4 and 5 illustrate the outer snib lever 35 and inner snib lever 36 both having a substantially square spindle 12, 11, only the inner snib lever 36 has a protruding portion 98 which extends the full length of the spindle 11 so as to interact with the radially extending groove 96, 97 of each lock hub 94, 95. Accordingly, the spindle 12, 11 of either snib lever 35, 36 could be inserted into either of lock hub 53, 54 and actuator hub 51, 52, however only the spindle 11 of the inner snib lever 36 can interact with either the lock hub 53, 54 in such a manner so as to rotate it about the axis X-X. In this way the latch assembly 1 can be adjusted between a left hand operating and a right hand operating assembly by switching over the snib levers 35, 36.

Figure 6:
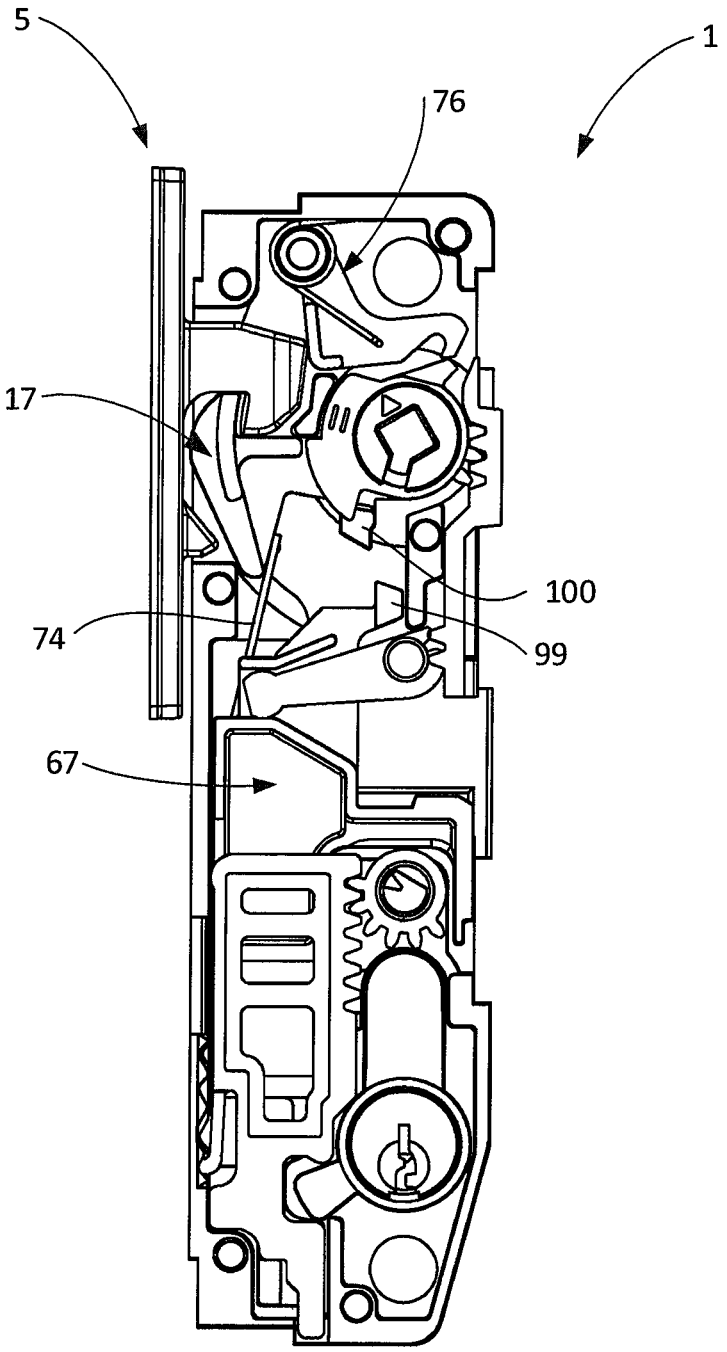
FIG. 6 illustrates a side elevation view of the latch assembly with the bolt engaging the strike such as when the door is in a closed position.

The operation of the latch assembly 1 will now be described in greater detail by reference to FIGS. 6 to 9. FIG. 6 illustrates the latch assembly 1 positioned adjacent the strike 5 whereby the bolt 17 is engaging the hook 16 as would be the case when the door 6 is in a closed position. Furthermore, the lock mechanism is considered to be in an inactive position whereby a shoulder 99 of the detent member 67 is spaced from a shoulder 100 formed on the bolt 17 (See also FIG. 3). Still furthermore the pawl 76 has released the bolt 17 to enable the bolt 17 to adopt the latch position.

Figure 7:
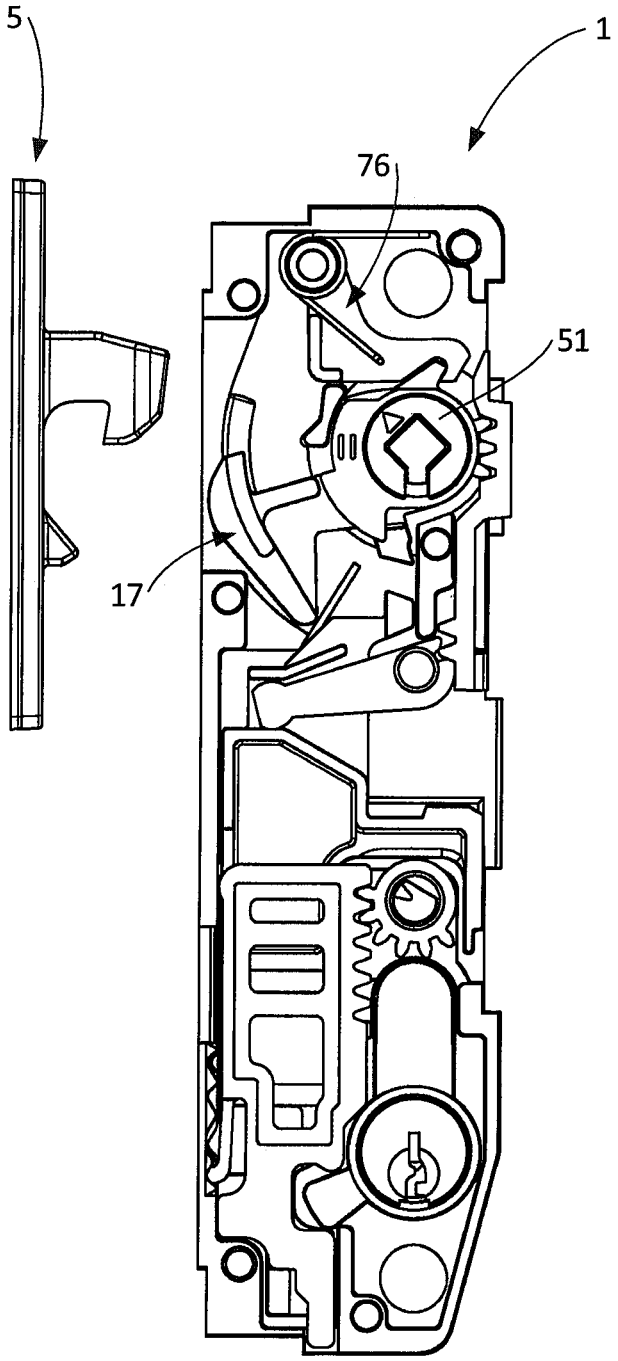
FIG. 7 illustrates a side elevation view of the latch assembly from FIG. 6 with the bolt rotated to a release position.
Figure 7A:
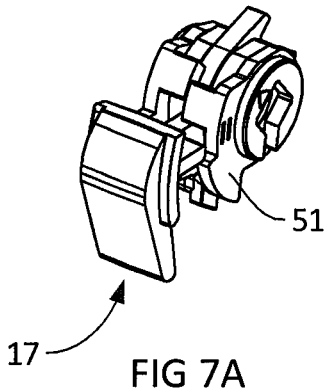
FIG. 7*a* illustrates an isometric view of the outer actuator hub rotating the bolt to the release position.

FIG. 7 illustrates the outer actuator hub 51 having been rotated about the axis X-X to rotate the bolt 17 (See also FIG. 7*a*) to a release position. This allows the door 6 (see FIG. 1) to be moved to an open position whereby the latch assembly 1 is spaced from the strike 5. It should also be noted from FIG. 7 that once the bolt 17 is in the release position, the pawl 76 interacts with the bolt 17 to retain the bolt 17 in the release position whilst the latch assembly is spaced from the strike.

FIG. 8 illustrates the lock mechanism in an active condition. This has been achieved by the inner lock hub 54 having been rotated clockwise which in turn drives the slide member 61 vertically down. This causes the lever 65 to pivot and raise the detent member 67 so that the shoulder 99 of the detent member 67 is positioned behind a shoulder 100 formed on the bolt 17 (see FIG. 8*a*). While the detent member 67 remains in this position, the bolt 17 is prevented from rotating counter clockwise about the axis. It should also be noted that when comparing FIGS. 7 and 8 that the deadlatching member 84 has been raised in conjunction with the raising of the detent member 67. This is achieved by a lug 101 of the detent member 67 is located under a leg 102 of the deadlatching member 84 (see also FIG. 3). It can also be seen that the latch 85 has moved up one position in the rib formation 86. The raising of the deadlatching member 84 causes the pinion 89 to rotate, so as to rotate the indicator 43. This rotation causes the adjustment of the indicator 43 to indicate on an inner side of the lock assembly 1 that the lock mechanism is now in an active condition (see FIG. 3 for the indicator).

Figure 9:
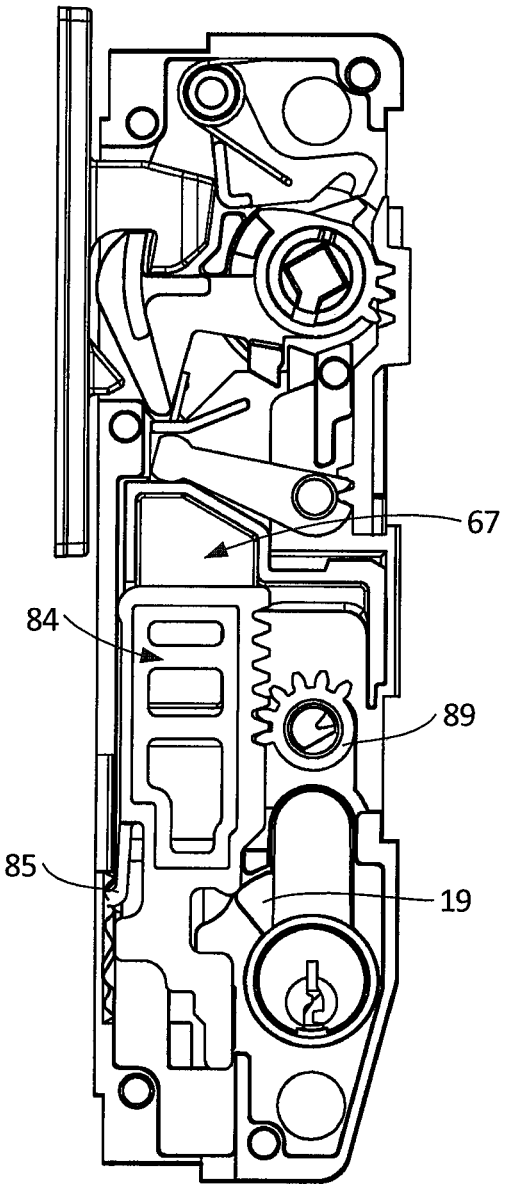
FIG. 9 illustrates a side elevation view of the latch assembly from FIG. 8 with a deadlatching member in a deadlatching position.

Referring now to FIG. 9 which illustrates the deadlatching member 84 in a deadlatching position having been raised relative to the detent member 67 by rotation of the cylinder lock cam 19. It can be seen that the latch has been raised to the upper position in the rib formation, and that the pinion 89 has been further rotated. This further adjusts the condition of the indicator 43 (see FIG. 3) on the inner side of the latch assembly 1 to indicate that the deadlatching member 84 is now in a deadlatching position.

Figure 9A:
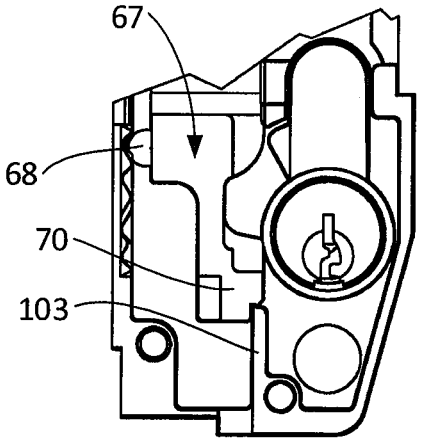
FIG. 9*a* is a partial side elevation view showing a detent member engaging an abutment portion of the latch assembly housing.

It should be noted that FIG. 9*a* has the deadlatching member 84 removed for greater visibility of the detent member 67. In particular it can be seen that the action of the ball detent 68 has caused a slight pivoting of the detent member 67 so as to position the lower leg 70 over a vertical wall 103 in the base 48. This prevents the detent member 67 from being moved from this position without operation of the cylinder lock 4 to push against the action of the ball detent 68.

The invention claimed is:

1. A latch assembly for use with a sliding door including a housing, a bolt movable relative to the housing between a latching position and a release position, a pair of actuator hubs that are each rotatable about an axis to move the bolt from the latching position to the release position, a lock mechanism including a pair of lock hubs that are each rotatable about the axis to adjust the lock mechanism between an inactive condition and an active condition so as to permit and prevent movement of the bolt from the latching position respectively, an inner hand operable member and an outer hand operable member for operation from an inner side and an outer side of the door respectively, the inner hand operable member is configured to interact with either one of the actuator hubs and either one of lock hubs while the outer hand operable member is configured to interact with either one of the actuator hubs.

2. A latch assembly according to claim 1 wherein the inner hand operable member includes an inner spindle and each lock hub includes an aperture shaped to interact with the inner spindle so that rotation of the inner hand member rotates either said lock hub.

3. A latch assembly according to claim 2 wherein the aperture in each lock hub includes a groove portion shaped to mate with a protruding portion of the inner spindle.

4. A latch assembly according to claim 3 wherein the outer hand operable member includes an outer spindle, the outer spindle and the inner spindle each having a central portion, each actuator hub including an aperture which is shaped to mate with the central portion of either the inner spindle or the outer spindle.

5. A latch assembly according to claim 4 wherein the outer spindle is configured so that rotation of the outer hand operable member rotates its respective actuator hub relative to its respective lock hub.

6. A latch assembly according to claim 1 including a biasing means acting on the bolt urging it towards the latching position, and wherein the bolt is a hook bolt that rotates about the axis when adjusting between the latching position and the release position.

7. A latch assembly according to claim 1 including a pawl which interacts with the bolt when it is in the release position preventing it from moving to the latching position until the bolt is positioned adjacent an associated strike.

8. A latch assembly according to claim 1 wherein the lock mechanism includes a detent member that moves relative to the bolt when the lock mechanism adjusts between the active condition and the inactive condition.

9. A latch assembly according to claim 8 including a key operated cylinder lock having a cam that is rotatable about a cylinder lock axis on operation of the cylinder lock, and a deadlatching member interacts with the detent member and moves relative to the detent member on rotation of the cam between a deadlatching position and a release position whereby when in the deadlatching position the lock mechanism is inhibited from adjusting from the active condition.

10. A latch assembly according to claim 9 wherein the detent member is formed with a pair of opposed shoulders that interact with the cam so that the detent member is movable relative to the bolt on rotation of the cam.

11. A latch assembly according to claim 10 wherein the deadlatching member includes a catch, and the housing includes an inner surface configuration which the catch interacts with so as to inhibit movement of the deadlatching member relative to the housing from the deadlatching position unless by way of rotation of the cam.

12. A latch assembly according to claim 11 including an indicator visible from outside of the housing which interacts with the deadlatching member so as to visibly indicate if the deadlatching member is in a deadlatching condition or if the lock mechanism is in an active condition.

13. A latch set including a latch assembly according to claim 1, also including door furniture for positioning adjacent an inner surface and an outer surface of the door, the door furniture including escutcheons each having a cover member and a pull member for engagement by the hand of the user when sliding the door, each cover member having one aperture to accommodate one of said inner hand operable member or outer hand operable member therethrough, each cover member and pull member being configured to permit the pull member to be positioned adjacent either a left hand edge or a right hand edge of the cover member when the escutcheon is attached to the door.

* * * * *